United States Patent [19]

Burkman et al.

[11] Patent Number: 4,809,126

[45] Date of Patent: Feb. 28, 1989

[54] ELECTROSTATIC DISCHARGE PROOF KEYPAD

[75] Inventors: Jack L. Burkman; Gretchen R. Oosterhout, both of Vancouver, Wash.

[73] Assignee: Hewlett-Packard Company, Palo Alto, Calif.

[21] Appl. No.: 83,497

[22] Filed: Aug. 5, 1987

[51] Int. Cl.[4] ..... H01H 9/02; H01H 13/70; H05F 3/02

[52] U.S. Cl. ..... 361/212; 200/5 A; 361/220

[58] Field of Search ..... 200/5 A, 159 B, 305, 200/314; 361/212, 220; 248/118

[56] References Cited

U.S. PATENT DOCUMENTS

| | | | |
|---|---|---|---|
| 4,040,120 | 8/1977 | Geadah et al. | 361/220 |
| 4,303,960 | 12/1981 | Sherwood et al. | 361/212 |
| 4,376,879 | 3/1983 | Nagata et al. | 200/314 |
| 4,439,646 | 3/1984 | Bouvrande | 200/314 X |
| 4,449,024 | 5/1984 | Stracener | 200/314 X |
| 4,456,800 | 6/1984 | Holland | 361/212 X |
| 4,481,556 | 11/1984 | Berke et al. | 248/118 X |
| 4,482,064 | 11/1984 | Berke et al. | 248/118 X |
| 4,586,106 | 4/1986 | Frazier | 361/212 |

FOREIGN PATENT DOCUMENTS

| | | | |
|---|---|---|---|
| 2571889 | 4/1986 | France | 200/305 |

*Primary Examiner*—J. R. Scott

*Attorney, Agent, or Firm*—S. A. Kassatly; Bloor Redding, Jr.

[57] ABSTRACT

A keypad which prevents electrostatic discharge from occurring in electronic equipment such as printers, computers and the like. The keypad includes a switch mechanism positioned on the circuit board associated with the electronic equipment. Attached to the switch mechanism is an actuating lengthening member of sufficient length to isolate the switch mechanism from electrostatic discharge through the keypad. A light source is also positioned under the keypad and the light source has attached thereto a light conducting lengthening member of sufficient length to isolate the light source from electrostatic discharge through the keypad. A method of preventing electrostatic discharge through a keypad to a circuit board is also disclosed.

6 Claims, 2 Drawing Sheets

ELECTROSTATIC DISCHARGE PROOF KEYPAD

BACKGROUND OF THE INVENTION (a) Field of the Invention

This invention relates generally to keypads for electronic equipment and in particular to a keypad which is resistant to electrostatic discharge through the keypad to the circuit board.

(b) Background Art

Electrostatic discharge through the keypad of a printer or other electronic equipment to the circuit board can damage the circuitry, cause the equipment to lose memory stored therein or cause the equipment to cease performing interrupts required for operation of the equipment. In some cases, the equipment may cease to function altogether. Thus, damage caused to printers, computers, and peripheral equipment by electrostatic discharge has long been known and efforts have been made to control the amount of electrostatic discharge near this electronic equipment.

In printers with keypads, one previous proposed solution has been to use a conductive material around the keypad which attracts the electrostatic discharge whereby the discharge is then carried through the grounding path of the product. This has proven unsatisfactory in that there is no control of the electrostatic discharge energy as the charge tends to induce magnetic fields and may also jump to adjacent devices thereby causing varying degrees of damage.

SUMMARY OF THE INVENTION

In order to overcome problems inherent in the before described devices, there is taught in the present invention a new and novel device which prevents the electrostatic discharge from occurring in electronic equipment such as printers, computers and the like. The keypad of the present invention includes a switch mechanism which is positioned on the circuit board associated with the electronic equipment. Attached to the switch mechanism is an actuating lengthening member of sufficient length to isolate the switch mechanism from electrostatic discharge through the keypad. There is also provided in the present invention a light source in the form of a light emitting diode positioned below the keypad. Attached to the light emitting diode is a light conducting lengthening member of sufficient length to isolate the light source from electrostatic discharge through the keypad.

It is therefore an object and advantage of the present invention to provide a keypad for a printer, computer or the like which prevents electrostatic discharge from the top of the keypad through to the circuit board of the electronic equipment.

It is another object and advantage of the present invention to provide a keypad improvement which is relatively inexpensive to manufacture yet provides for the protection of expensive electronic equipment.

It is yet another object and advantage of the present invention to provide a keypad which prevents electrostatic discharge through both the keyswitch and the light source of the keypad.

These and other objects and advantages of the invention will become apparent after a review of the drawings and a study of the description of the preferred embodiment.

DESCRIPTION OF THE PREFERRED EMBODIMENT

Figure 1A:
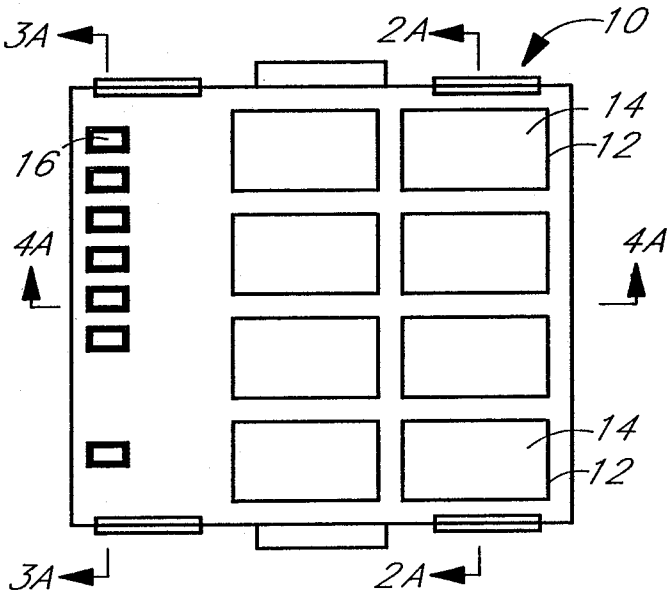
FIG. 1A is a top plan view of the keypad used in the present invention.

Referring now to the drawings in general and in particular to FIG. 1A of the drawings there is shown a top plan view of the keypad used in the present invention. In FIG. 1A there is shown the keypad generally by the numeral 10. Positioned on the keypad 10 are the switching mechanisms 12 in the form of keyswitches 14 which are pressed by the user when a particular function of the equipment is desired. In the present invention, wherein the keypad 10 is used on a printer, one such function might be a page advance key which would cause the printer to position a series of forms at the top of the next succeeding page. Also positioned on the keypad 10 are light indicators 16 which light up indicating that the particular function requested by the user through pressing of a keyswitch 14 is indeed being performed.

Figure 2A:
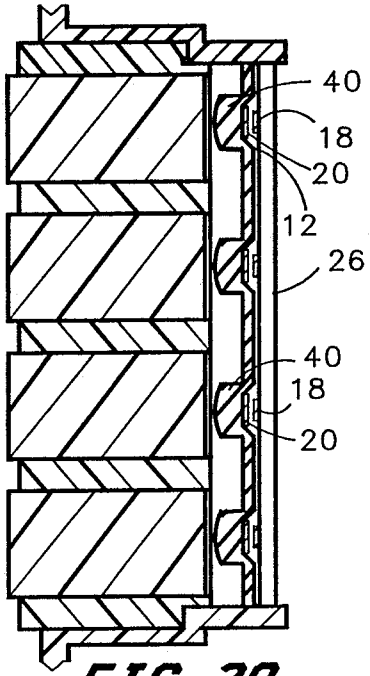
FIG. 2A is a cross-sectional view taken through line 2—2 of FIG. 1 showing the keyswitches of the present invention in greater detail.

Referring now to FIG. 2A of the drawings there is shown a cross-sectional view taken through line 2A—2A of FIG. 1A showing one column of the keyswitches 14 in greater detail. Each switching mechanism 12 in the form of a keyswitch 14 has a top portion 18 and a bottom portion 20. In the preferred embodiment, each keyswitch 14 has attached at its bottom portion 20 an actuating lengthening member 22 in the form of a keycap 24. The keycap 24 is of sufficient length to isolate the switch mechanism 12 from electrostatic discharge through the keypad 10 to the circuit board 26.

Figure 3A:
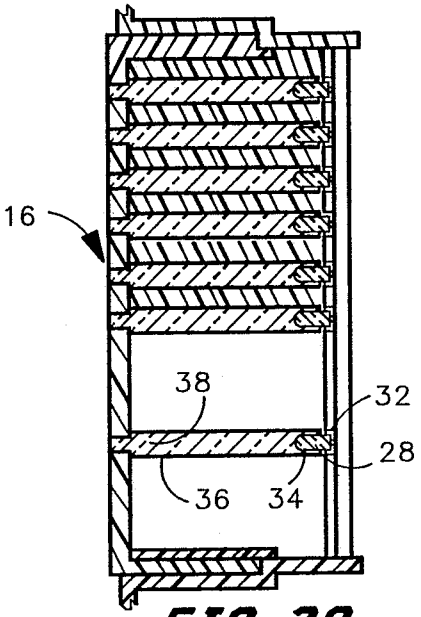
FIG. 3A is a cross-sectional view taken through line 3—3 of FIG. 1 showing the light indicators of the present invention in greater detail.

In FIG. 3A there is shown a cross-sectional view taken through line 3A—3A of FIG. 1 showing greater detail on the light indicators 16. In FIG. 3A there is a light source 28 and in the preferred embodiment, the light source 28 is in the form of a light emitting diode 30. Each light emitting diode 30 has a top portion 32 and a bottom portion 34. In the preferred form, each light emitting diode 30 has connected to its bottom portion 34 a light conducting lengthening member 36 in the form of a light pipe 38. The light pipe 38 is of sufficient length to isolate the light source 28, in the form of a light emitting diode 30, from electrostatic discharge through the keypad 10 to the circuit board 26.

Figure 4A:
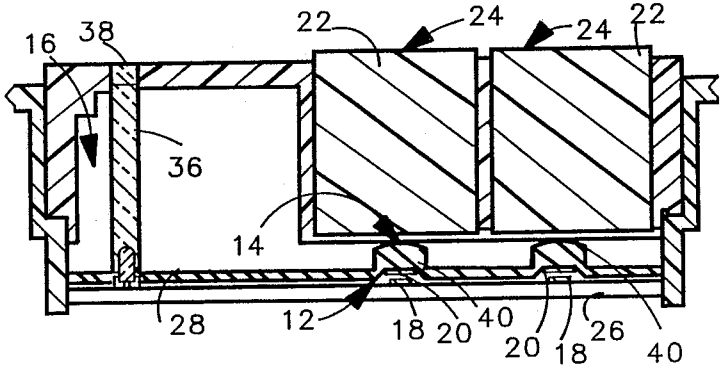
FIG. 4A is a cross-sectional view taken through line 4—4 of FIG. 1 showing the keyswitches and light sources of the present invention as they are positioned under the keypad.

In FIG. 4A there is shown a cross-sectional view taken through line 4A—4A of FIG. 1 showing how the keyswitches and light emitting diodes are positioned under the keypad in the present invention. In FIG. 4A there is shown the light source 28 in the form of a light emitting diode 30 having attached thereto the light conducting lengthening member 36 in the form of a light pipe 38 to isolate the light emitting diode 30 from electrostatic discharge through the keypad 10. In the preferred embodiment, the keyswitch 14 is in the form of a dome switch 40 and the keyswitch 14 includes a rubber pad 42 positioned under the keycap 24. The rubber pad 42 and the dome switches 40 serve to create an air gap to separate the keycap 24 from the circuit board 26 so that when not used there is an open circuit on the circuit board 26. In operation then, as the user presses keycap 24, the keycap 24 moves downwardly against the dome switch 40, and the dome switch 40 completes the circuit on the circuit board 26 whereby the appropriate function is thus performed. The switching mechanism 12 in the form a keyswitch 14 is shown as it is positioned distance from the circuit board 26 by actuating lengthening member 22 in the form of a keycap 24 to isolate the keyswitch 14 from electrostatic discharge through the keypad 10. In the preferred embodiment, together, the keyswitch 14 and the light emitting diode 30 are positioned a sufficient distance from the circuit board 26 so that electrostatic discharge is prevented from discharging to the circuit board 26 from the top of the keypad 10.

A method for preventing electrostatic discharge through a keypad 10 to a circuit board 26 is also disclosed wherein a switch mechanism 12 is provided. An actuating lengthening member 22 is provided of sufficient length to isolate the switch mechanism 12 from electrostatic discharge through the keypad 10. The actuating lengthening member 22 is attached to the switch mechanism 12 whereby electrostatic discharge from the keypad 10 to the circuit board 26 is prevented. An additional method for preventing electrostatic discharge through a keypad 10 to a circuit board 26 is also disclosed wherein a light source 28 is provided. A light conducting lengthening member 34 is provided of sufficient length to isolate the light source 28 from electrostatic discharge through the keypad 10. The light conducting lengthening member 34 is attached to the light source 28 whereby electrostatic discharge from the keypad 10 to the circuit board 26 is prevented.

From the foregoing, it can be seen that the applicant's invention provides a keypad which is resistant to electrostatic discharge through the keypad to the circuit board, having a switch mechanism and an actuating lengthening member attached thereto of sufficient length to isolate the switch mechanism from electrostatic discharge through the keypad and an additional embodiment which further has a light source and a light conducting lengthening member attached thereto of sufficient length to isolate the light source from electrostatic discharge through the keypad. The keypad which is resistant to electrostatic discharge through the keypad is relatively inexpensive to manufacture yet provides protection of expensive electronic equipment.

It should be apparent after studying the drawings and reading the description of the preferred embodiment that various changes may be made in the arrangement of the parts and the positioning of the various elements. The applicant is not to be limited to the exact embodiment shown which has been given by way of illustration only.

What is claimed as the invention is:

1. A keypad (10) for use in electronic equipment having a circuit board 26, and for preventing the occurrence of electrostatic discharge, the keypad comprising:

(a) switch means (12) connected to the circuit board for selecting particular functions of the equipment;

(b) keycap means (24) secured to said switch means for enabling a user to actuate said switch means without causing an electro-static discharge from the user's body to the electronic equipment and to the circuit board;

(c) said keycap means being interposed intermediate the circuit board and the user, for insulating the circuit board from the user;

(d) said keycap means having a sufficient length necessary to prevent any electro-static discharge from taking place, and to eliminate the need for conventional ground paths designed to conduct electro-static discharges through the keypad; and (e) said keypad means having a suitable dielectric composition to prevent the formation of an electro-static discharge therethrough.

2. The keypad as defined in claim 1, further including a visual indicator (16) for use in the electronic equipment, and for preventing the occurrence of electrostatic discharge, the indicator comprising:

(a) light source (28) connected to the circuit board for providing visual indications of particular functions of the equipment;

(b) light conducting lengthening means (36) secured to said light source for enabling a user to physically approach or touch the equipment without causing an electro-static discharge from the user's body to the electronic equipment and to the light source;

(c) said light conducting lengthening means being interposed intermediate the light source and the user, for insulating the circuit board from the user;

(d) said light conducting lengthening means having a sufficient length necessary to prevent any electro-static discharge from taking place, and to eliminate the need for conventional ground paths designed to conduct electro-static discharges through the indicator; and (e) said light conducting lengthening means having a suitable generally transparent and dielectric composition to prevent the formation of an electro-static discharge therethrough, while enabling the light to pass through.

3. The keypad as defined in claim 2, wherein said switch means includes a generally dome switch (40) and a rubber pad (42) positioned underneath said keycap means.

4. A visual indicator (16) for use in electronic equipment having a circuit board (26), and for preventing the occurrence of electrostatic discharge, the indicator comprising:

(a) light source (28) connected to the circuit board for providing visual indications of particular functions of the equipment;

(b) light conducting lengthening means (36) secured to said light source for enabling a user to physically approach or touch the equipment without causing an electro-static discharge from the user's body to the electronic equipment and to the light source;

(c) said light conducting lengthening means being interposed intermediate the light source and the user, for insulating the circuit board from the user;

(d) said light conducting lengthening means having a sufficient length necessary to prevent any electro-static discharge from taking place, and to eliminate the need for conventional ground paths designed to conduct electro-static discharges through the indicator; and (e) said light conducting lengthening means having a suitable generally transparent and dielectric composition to prevent the formation of an electrostatic dischage therethrough, while enabling the light to pass through.

5. A method for preventing the occurrence of electrostatic discharge through a keypad for use in electronic equipment having a circuit board, the m ethod comprising:

(a) connecting switch means (12) to the circuit board for selecting particular functions of the equipment;

(b) securing keycap means (24) to said switch means for enabling a user to actuate said switch means without causing an electro-static discharge from the user's body to the electronic equipment and to the circuit board;

(c) interposing said keycap means intermediate the circuit board and the user, for isulating the circuit board from the user;

(d) providing said keycap means with a sufficient length to prevent any electro-static discharge from taking place, and to eliminate the need for conventional ground paths designed to conduct electro-static discharges through the keypad; and (e) said keycap means having a suitable dielectric composition to prevent the formation of an electro-static discharge therethrough.

6. The method as defined in claim 5, wherein the keypad includes a visual indicator (16) for use in the electronic equipment, and for preventing the occurrence of electrostatic discharge, the method further including the steps of:

(a) connecting a light source (28) to the circuit board for providing visual indications of particular functions of the equipment;

(b) securing light conducting lengthening means (36) to said light source for enabling a user to physically approach or touch the equipment without causing an electro-static discharge from the user's body to the electronic equipment and to the light source;

(c) interposing said light conducting lengthening means intermediate the light source and the user, for insulating the circuit board from the user;

(d) providing said light conducting lengthening means with a sufficient length to prevent any electro-static discharge from taking place, and to eliminate the need for conventional ground paths designed to conduct electro-static discharges through the indicator; and (e) said light conducting lengthening means having a suitable generally transparent and dielectric composition to prevent the formation of an electro-static discharge therethrough, while enabling the light to pass through.

* * * * *